US005520864A

United States Patent [19]

Frei

[11] Patent Number: 5,520,864

[45] Date of Patent: May 28, 1996

[54] CONTROLLED MIXTURE FORMATION

[76] Inventor: Beat Frei, Eschenhof, CH-4512 Bellach, Switzerland

[21] Appl. No.: 387,807

[22] PCT Filed: Aug. 21, 1992

[86] PCT No.: PCT/EP92/01922

§ 371 Date: Feb. 21, 1995

§ 102(e) Date: Feb. 21, 1995

[87] PCT Pub. No.: WO94/04812

PCT Pub. Date: Mar. 3, 1994

[51] Int. Cl.[6] ..... F02M 17/16

[52] U.S. Cl. ..... 261/88

[58] Field of Search ..... 261/88, 84

[56] References Cited

U.S. PATENT DOCUMENTS

| | | | |
|---|---|---|---|
| 4,187,264 | 2/1980 | Diener | 261/84 |
| 4,283,358 | 8/1981 | Diener | 261/88 |
| 4,353,848 | 10/1982 | Carsten . | |
| 4,388,253 | 6/1983 | Maxwell | 261/88 |
| 4,469,075 | 9/1984 | Jackson et al. . | |
| 4,725,385 | 2/1988 | Diener et al. | 261/88 |

FOREIGN PATENT DOCUMENTS

| | | |
|---|---|---|
| 208802 | 1/1987 | European Pat. Off. . |
| 209073 | 1/1987 | European Pat. Off. . |
| 2133134 | 1/1973 | Germany . |
| 2407995 | 1/1975 | Germany . |
| 2809066 | 9/1979 | Germany . |
| 3024181 | 2/1981 | Germany . |
| 389540 | 5/1976 | Sweden . |
| 606784 | 11/1978 | Switzerland . |
| 663823 | 10/1988 | Switzerland . |
| 1588856 | 4/1981 | United Kingdom . |
| 2149847 | 6/1985 | United Kingdom . |
| 83/04282 | 12/1983 | WIPO . |
| 84/03735 | 9/1984 | WIPO . |
| 85/00412 | 1/1985 | WIPO . |

OTHER PUBLICATIONS

C. Lech and V. Harms, entitled "Lean–Burn S. I. Engines Running on Relative A/F Mixtures of 1.4 and 1.7".

International Search Report, PCT/EP92/01922, 10 May 1993.

*Primary Examiner*—Tim R. Miles

*Attorney, Agent, or Firm*—Greenblum & Bernstein

[57] ABSTRACT

Controlled mixture formation. This invention pertains to the generation of homogenous mixtures having a freely selectable composition and is produced by using a rotary distribution cup driven by its own motor, with metered quantities of fuel being supplied to the pre-chamber of a rotary fuel distribution cup via a feed pipe extending through a metering valve in such a manner that the composition of the mixture produced in each case can be adjusted, irrespective of the amount of the air, over the entire operating range of the internal combustion engine, with the fuel being radially distributed by centrifugal force, very finely divided and mixed with air in a mixing chamber wherein the quantity and composition of the mixture are adjusted by means of the metering valve in conjunction with a control valve in such a way that the production of the mixture and its conveyance take place at approximately ambient pressure, with a motor performance graph establishing the optimum setting for the metering and regulating valves for mixture production at approximately ambient pressure while improving fuel consumption and the exhaust gas quality, with the invention, in connection with the noted control system being especially suitable for the best possible operation of four-stroke engines with lean fuel mixtures at lambda values of at least 1.5.

19 Claims, 4 Drawing Sheets

CONTROLLED MIXTURE FORMATION

CROSS REFERENCE TO RELATED APPLICATION

This application claims the priority of PCT Application No. PCT/EP92/01922, filed Aug. 21, 1992, the disclosure of which is incorporated herein by reference in its entirety.

BACKGROUND OF THE INVENTION

1. Field of the Invention

The invention relates to the generation of homogeneous mixtures and in particular to a process and mixture-generating apparatus for continuously generating homogeneous mixtures of freely selectable composition in a mixing chamber with an inlet, a feed pipe, a rotary fuel distributor and a mixture outlet.

It further relates to the supply of internal combustion engines with ignitable fuel-air mixtures by external mixture formation, particularly of Otto engines, as well as a control system, which is particularly provided for supplying Otto engines with lean fuel-air mixtures.

2. Discussion of the Background of the Invention and Material Information

Various types of apparatus have been proposed for producing ignitable fuel-air mixtures, and the following patent publications are cited for example in this connection: U.S. Pat. Nos. 4,353,848, 4,469,075, GB 1,588,856, DE 2 809 066 A1, DE 3 024 181 A1, WO 84/03735 A1, WO 83104282 A1, WO 85/00412 A1, CH 663823, CH 606784, EP 0209073 A2 and EP 0208 802 A1.

However, under variable operating conditions, meeting the conditions for efficient combustion by very fine division of the fuel and uniform mixing with the combustion air is particularly problematic inasmuch as the required composition cannot be ensured under transient operating conditions, when uncontrolled amounts of fuel are carried along with the fuel mixture.

That is why efficient fuel control with strongly variable air quantities on one hand and the use of technical means which are as simple as possible on the other hand are of critical importance for trouble-free continuous operation of motor vehicles in the entire operating range.

Motor vehicles with gasoline-engine propulsion are currently provided with the known three-way catalyst as standard equipment in order to meet the legal provisions regarding the admissible limits for emission of pollutants.

The so-called lean-burn engine concept is moreover mentioned within the framework of constant discussions regarding measures for reducing the emission of pollutants. The operation of gasoline engines with lean fuel-air mixtures with significant excess air according to the lean-burn concept offers the possibility of reducing the emission of pollutants and at the same time reducing fuel consumption. The fuel consumption of the gasoline engine could thereby be optimized.

The interest in the development of so-called lean engines or lean-mixture engines, i.e. Otto engines which operate with above-stoichiometric air/fuel ratios (Lambda values significantly greater than 1) is clearly apparent from numerous publications.

An article by G. Lech and V. Harms in the technical journal "Motortechnische Zeitschrift", 47 (1986), p. 423–427, relates to the problems of lean combustion under variable air conditions (Lambda values up to 1.7).

The requirements for operating motor vehicles with lean-burn engines are, however, very strict and partly contradictory.

Investigations in the framework of the present invention now have shown that the potential advantages of the lean-engine concept for the operation of Otto engines with lean mixtures with high excess air can only be achieved when no layer-charge combustion or twist combustion similar to layer-charge combustion occurs, i.e. when the combustion takes place uniformly in the entire operating range of the engine. Only in this way can it be achieved that the engine temperature in the advancing flame front is uniform, hence homogeneous and does not present any peak values as a result of non homogeneous charge distribution in the combustion chamber.

It is an object of the invention to ensure, through relatively simple and reliable technical means, the continuous formation of homogeneous mixtures of freely selectable composition, particularly ignitable fuel-air-mixtures and efficient mixture control with reduction of the emission of pollutants and fuel consumption.

A further object of the invention is to ensure, under all required operating conditions and particularly under transient operating conditions, automatic control of mixture formation by the finest possible fuel distribution as well as uniform mixing with the combustion air at variable air flow rates.

The invention further has the special object of ensuring the supply of internal-combustion engines with lean mixtures which are homogeneous and have a freely selectable composition with as high excess air as possible, in order to thereby particularly guarantee optimal operation of Otto engines in their entire operating range.

SUMMARY OF THE INVENTION

These objects are met by the process the control system and the mixture-generating apparatus set forth in the appended claims.

The process for generating mixtures essentially consists, according to the invention, in the combination of prior metering and axial delivery of one component of the mixture into the rotary distributor cup with its own motor drive on one hand and the fine distribution of this component by centrifugal force by means of this distributor cup on the other hand, so as to thereby produce homogeneous mixtures of predetermined composition in each case.

For the supply of internal combustion engines, the rotary distributor cup is advantageously driven by a motor which is independent of the operating condition of the internal combustion engine and is fed with metered amounts of fuel, so that the composition of the mixture produced in each case is adjustable irrespective of the amount in the entire operating range of the internal combustion engine.

For supplying Otto or internal combustion engines a fuel-metering valve operatively associated with a control flap is further controlled in a previously defined, preferred operating range of the Otto engine, so that fuel is supplied to said rotary distributor via said metering valve in amounts which are in each case adapted to the required engine power so that the Otto engine may be optimally operated at each operating point in the said preferred operating range, the amount and the composition being continuously adapted to each desired operating point with the help of the control flap in combination with said metering valve.

The amount and the composition of the mixture are continuously adapted to the desired operating point in each case with the help of the control flap in combination with the metering valve.

The control flap is preferably adjusted at each operating point so as to enable the formation and transport of the mixture in the intake pipe of the engine approximately at atmospheric pressure in most of the operating points of the preferred operating range.

Otto engines are supplied according to the invention with very lean mixtures with at least 50% excess air, namely having a Lambda value of at least 1.5 and preferably around 1.8 or higher.

An engine performance graph is in this case established in the preferred operating range of the Otto engine, which determines the optimal adjustment of the control flap and the fuel-metering valve at respective operating points, so as to enable the preparation and supply of mixtures to the Otto engine to take place approximately at atmospheric pressure in the preferred operating range and reduction of the fuel consumption and the emission of pollutants.

The outlet of the mixing chamber is in this case preferably adapted to the intake manifold, so as to allow the transport of the fuel mixture to the Otto engine to occur with insignificant pressure loss.

The preferred range for operating the Otto engine with lean mixtures of freely selectable composition and as high excess air as possible may be advantageously defined in advance by step-wise scanning the operating range of Otto engine at different engine speeds and loads, determining in each case the fuel consumption, the composition of the mixture and the exhaust gas and the intake pressure, establishing an engine performance graph by adjusting the control flap in combination with the metering valve, which establishes the optimal setting of the control flap at respective operating points, so that when operating with as high excess air as possible in the preferred operating range of the Otto engine, the preparation and supply of mixture to the Otto engine occur essentially at atmospheric pressure, so that fuel consumption can be reduced and the emission of pollutants lowered.

The amount of intake air of the internal combustion engine may on the other hand be exactly determined either directly, for example by means of a hot-wire anemometer, or indirectly via the measured intake pressure, the temperature and the engine speed.

The control system according to the invention advantageously comprises a data processing unit with a microprocessor unit which in conjunction with a data storage unit simultaneously controls the fuel metering valve and the servomotor of said control flap as well as the ignition of the Otto engine as a function of the power required from the Otto engine and the engine speed in accordance with a stored program corresponding to an engine performance graph in the previously defined operating range of the Otto engine.

The microprocessor unit in this case receives in addition to a signal corresponding to the power required from the Otto engine, on one hand via corresponding sensors on the Otto engine input signals relating at least to the engine speed, the intake pressure and the temperature of the Otto engine. It receives on the other hand via outside sensors further input signals at least relating to the atmospheric pressure and the ambient temperature in each case.

The microprocessor unit in conjunction with the data storage unit further continuously delivers control signals as a function of said input signals in said preferred operating range of the Otto engine for respectively controlling said fuel metering valve, the servomotor of said control flap and the ignition of the Otto engine.

Every operating point in that case exactly defines the setting of said control flap, of said metering valve and the engine ignition through predetermined values of the corresponding control signals so as to enable the Otto engine to be optimally operated in the entire preferred operating range with mixtures of freely selectable composition with maximum excess air while reducing fuel consumption and emission of pollutants.

The mixture-generating apparatus according to the invention essentially comprises a rotary distributor cup with an individual driving motor, a distributing plate and an ascending cylinder with an upper distributing edge, a feed pipe with a metering valve and an annular space between said rotary cup and the wall of the mixing chamber, the free end of the feed pipe extending axially without contact into the distributor cup and its outlet opening being disposed at an axial distance from said distributor cup.

Said distributor cup advantageously comprises a central prechamber which is open at one end and comprises a bottom at the other end, the free end of said feed pipe extending axially without contact into said prechamber and its outlet opening being centrally arranged at said axial distance from said bottom.

A control flap is further provided with a servomotor so as to enable the metering valve with the help of the control flap to continuously adjust the composition and the amount of the mixture so that mixture formation and transport can take place approximately at atmospheric pressure. This control flap is preferably disposed near the outlet of the mixing chamber.

The mixing chamber is advantageously designed with the rotary cup so that they define an aerodynamically advantageous flow path between the air inlet and the mixture outlet Investigations within the framework of the present invention have shown that the formation of homogeneous mixtures in accordance with the invention practically eliminates the troublesome liquid film formation on channel walls which otherwise usually occurs in external mixture formation. This may be due to the liquid fuel being extremely finely and uniformly distributed in the homogeneous mixture and the mixtures with high excess air being unsaturated, while any wall-wetting which may possibly occur may be quickly evaporated.

But one could provide the wall of the mixing chamber of the mixture generator according to the invention with a heating jacket to be on the safe side.

The free end of the driving shaft may moreover comprise a blind hole forming the central prechamber with the bottom.

The rotary distributor cup may advantageously comprise a central hollow stub defining the central prechamber, while the driving shaft constitutes with the hollow stub an annular intermediate compartment which communicates via a first radial bore with the central prechamber and via a second radial bore with the distributing surface of the plate. These radial bores are preferably arranged diametrically opposite one another.

Said driving motor may be advantageously arranged beneath the distributor cup, while the distributing edge is freely arranged and delivers the fuel radially, so that it is mixed with the surrounding air.

Said distributor cup is here advantageously covered with a hood which widens from the air inlet towards the distributing edge, so that air is delivered unimpeded to the rotary distributor.

A fixed casing for mounting the distributor cup may be advantageously provided in such a manner that it forms a streamlined annular channel between the air inlet and the mixture outlet.

The driving motor may moreover be arranged beneath the distributor cup and be arranged with the latter within the casing in such a manner that the free end of the driving shaft extends downwards axially into the hollow stub of the distributor cup, while this cup projects below the driving motor at the bottom end of said casing.

The driving shaft can in this case extend downwards through the driving motor and the hollow stub and have an axial bore and be closed at its lower end so that it forms the central prechamber and the feed pipe extends downwards without contact through this axial bore.

According to another embodiment, the driving shaft extends downwards through the driving motor and the hollow stub while its lower end comprises a blind hole and thereby forms a prechamber open below with an upper bottom.

The feed pipe extends in this case from below into this prechamber, while its outlet opening lies at a distance from said bottom, the annular intermediate channel and the radial bores are disposed beneath the outlet opening and the upper end of the feed pipe is provided with a deflecting head, which diverts the emerging fuel downwards to the first radial bore.

At the lower end of this prechamber a terminal sleeve with an axial bore is in that case provided so that the feed pipe extends without contact through this axial bore.

The formation of mixtures in accordance with the invention is based particularly on the combined effect of on one hand the continuous metering and axial delivery of the fuel to the rotary distributor cup having a driving motor with on the other hand the immediately following removal and distribution of the fuel.

The fuel is here on one hand first exactly metered in the feed pipe, from which it freely emerges and is thereby axially metered to the distributor cup It is on the other hand immediately picked up by the rotary distributor cup, positively automatically spread out due to centrifugal force, finely divided and uniformly mixed with the surrounding air flow.

This combination now provides a special mode of operation in accordance with the invention, which now enables the continuous formation of homogeneous mixtures, control of the amount of fuel irrespective of the amount of air when forming the mixtures, constant exact adjustment of the composition and the amount of mixture produced with a metering valve in conjunction with a control flap, their immediate modification as required and to thereby enable them to be adapted to the required performance of the Otto engine in such a manner that the formation of the mixtures and transport in the intake line of can take place approximately at atmospheric pressure.

It has now been practically established that the combination according to the invention of fuel metering with the rotary distributor cup having, its own driving motor enables the exact adjustment and immediate modification of the composition of the mixture, also with strong and quick variations of the amount of air, of the amount of fuel and of the mixing ratio, while the rotary distributor with the driving motor always ensures the exact metering and extremely fine and uniform distribution of the fuel and thereby ensures perfect homogeneous mixture formation.

Bench tests have moreover shown that the mixture generator provided according to the invention with the rotating distributor cup and its own driving motor may be efficiently used with various liquid and gaseous fuels in exactly metered amounts and ensures the perfect formation of homogenous mixtures in all cases, which are particularly well suited for supplying internal combustion engines with ignitable mixtures of any desired composition in the entire operating range.

By fuel is understood any suitable liquid or gaseous fuel which can provide the advantages of the invention.

The lean mixtures which are suitable in the framework of the invention for supplying and optimally operating Otto engines are particularly mixtures with very high excess air of at least 50%, while they may preferably have Lambda values in the range from 1.6 to 1.8 or more.

The formation of mixtures was carried out according to the invention with a rotary distributor cup of the type more exactly described hereinafter, which is equipped with an electric driving motor of constant speed, for ensuring perfect formation of mixtures and control of the composition of the mixture in a large operating range.

The rotary cup may also be equipped with an adjustable-speed motor, in order to control the speed to promote optimally controlled mixture formation in an extended operating range.

Specifically, the invention includes a process for continuously generating fuel-air mixtures of a freely selectable composition in a mixing chamber including an air inlet, a mixture outlet, an axial central feed pipe for liquid fuel, with the feed pipe being operatively associated with a metering valve, and a rotary fuel distributor having a separate driving motor, and a central prechamber, with the prechamber having a bottom and at least one lateral opening for the liquid fuel, an annular channel being provided between the rotary distributor and a wall of said mixing chamber, with the liquid fuel being delivered to the rotary distributor via the prechamber, the process comprising:

(a) dividing the liquid fuel into fine drops by utilizing a rotary distributor in the form of a distributor cup, the distributor cup being open at the top and having an annular distributor plate with an upper annular distributing surface in communication with the central prechamber via the lateral opening and an ascending cylinder, with the cylinder having an ascending inner surface and an upper distributing edge;

(b) arranging the central feed pipe in the central prechamber so that the feed pipe extends axially without contact into the prechamber, with an outlet opening of the feed pipe being arranged at a sufficient axial distance from the bottom of the prechamber so that the liquid fuel can emerge unimpeded in any desired controlled amount from the outlet opening of the feed pipe;

(c) immediately radially carrying away the delivered liquid fuel via the bottom of the prechamber due to centrifugal force and conducting the liquid fuel, via the lateral opening, to the annular distributing surface of the rotary distributor cup; radially spreading out the liquid fuel and forming a continuous film on the distributing surface and on the inner ascending surface of the cylinder; continuously dividing the continuous film on the distributing surface of the ascending cylinder; delivering the divided droplets in the form of extremely fine fuel droplets; and intimately mixing the fine fuel droplets with air flowing in the annular channel; and (d) freely selecting the composition of the fuel-air mixture, in each case, by metering the fuel component of the fuel-air mixture via the metering valve irrespective of the amount of air being present.

The process of this invention is utilized for supplying internal combustion engines with ignitable fuel-air mixtures of a freely selectable composition, and includes supplying the fuel distributor cup with metered amounts of fuel in such a manner that the composition of the mixture produced in each case can be adjusted, irrespective of the amount of air, over the entire operating range of the internal combustion engine.

The process of this invention is further utilized for supplying internal combustion engines with ignitable fuel-air mixtures of a freely selectable composition, and includes controlling the fuel metering valve, operatively associated with a control flap, in a previously defined, preferred operating range of the internal combustion engine; supplying metered amounts of fuel to the rotary distributor cup via the metering valve, the metered amounts of fuel in each case being adapted to the required engine power in such a manner that the engine may be optimally operated at each operating point in the preferred operating range; and continuously adapting the amount and the composition of the fuel-air mixture to each desired operating point with the assistance of the control flap in combination with the metering valve.

The process of this invention also includes adjusting the control flap at each operating point in such a manner as to enable the formation and transport of the fuel-air mixture into an intake manifold of the internal combustion engine approximately at atmospheric pressure at most of the operating points in the preferred operating range.

The process of this invention is also utilized for operating internal combustion engines with lean fuel-air mixtures having a Lambda value of at least 1.5, and includes previously defining a preferred operating range and establishing an engine performance graph, the latter determining the optimal setting of the control flap and the fuel metering valve at respective operating points so as to enable the formation and supply of fuel-air mixtures approximately at atmospheric pressure in the preferred operating range of the internal combustion engine, thereby reducing fuel consumption and decreasing the emission of pollutants.

This invention also pertains to a mixture generating apparatus for carrying out the process of this invention, with the apparatus having a mixing chamber with a wall, an air inlet, a mixture outlet, a fixed feed pipe having a free end and an outlet opening operatively associated with a metering valve and a rotary distributor, with the rotary distributor being independently driven, a central prechamber having a bottom and at least one lateral opening, with an annular channel being provided between the rotary distributor and the wall of the mixing chamber, wherein:

(a) the distributor consists of a rotary cup having a distributing plate and an annular distributing surface, with the distributing surface communicating with the prechamber via the at least one lateral opening; and an ascending cylinder having an upper distributing edge; and (b) the free end of the feed pipe extending axially and without contact into the prechamber, with said outlet opening being disposed at an axial distance from the bottom of the prechamber in such a manner so as to enable the liquid fuel to emerge unimpeded and to be immediately carried away, due to centrifugal force, by the bottom of the prechamber and to be supplied via the lateral opening to the distributing surface of the rotary cup and to be radially spread out thereon in the form of a film and to be finely divided at the upper distributing edge.

The mixture generating apparatus of this invention is also utilized for supplying internal combustion engines with fuel-air mixtures according to the process of this invention, with the apparatus further including: a control flap, with the control flap being provided with a servomotor so as to enable the metering valve, with the aid of the control flap, to continuously adjust the composition and the amount of the mixture as well as the mixture to be formed and transported at approximately atmospheric pressure.

The mixture generating apparatus of this invention further includes a driving shaft for rotating the rotary distributor, with a free end of the driving shaft comprising a blind hole, the blind hole, in turn, constituting the central prechamber including said bottom.

The mixture generating apparatus of this invention also includes a driving shaft and wherein said distributor cup comprises a central hollow stub, with the stub limiting the central prechamber, with the driving shaft in combination with the hollow stub constituting an annular intermediate compartment, the latter communicating at least, via a first radial bore, with the central prechamber and, via a second radial bore, with the distributing surface of the distributing plate.

The mixture generating apparatus of this invention further includes a driving motor, with the driving motor being disposed beneath the distributor cup, while a distributing edge of the distributing surface is freely arranged and delivers the fuel radially, so that the fuel is mixed with the surrounding air.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

Figure 1:
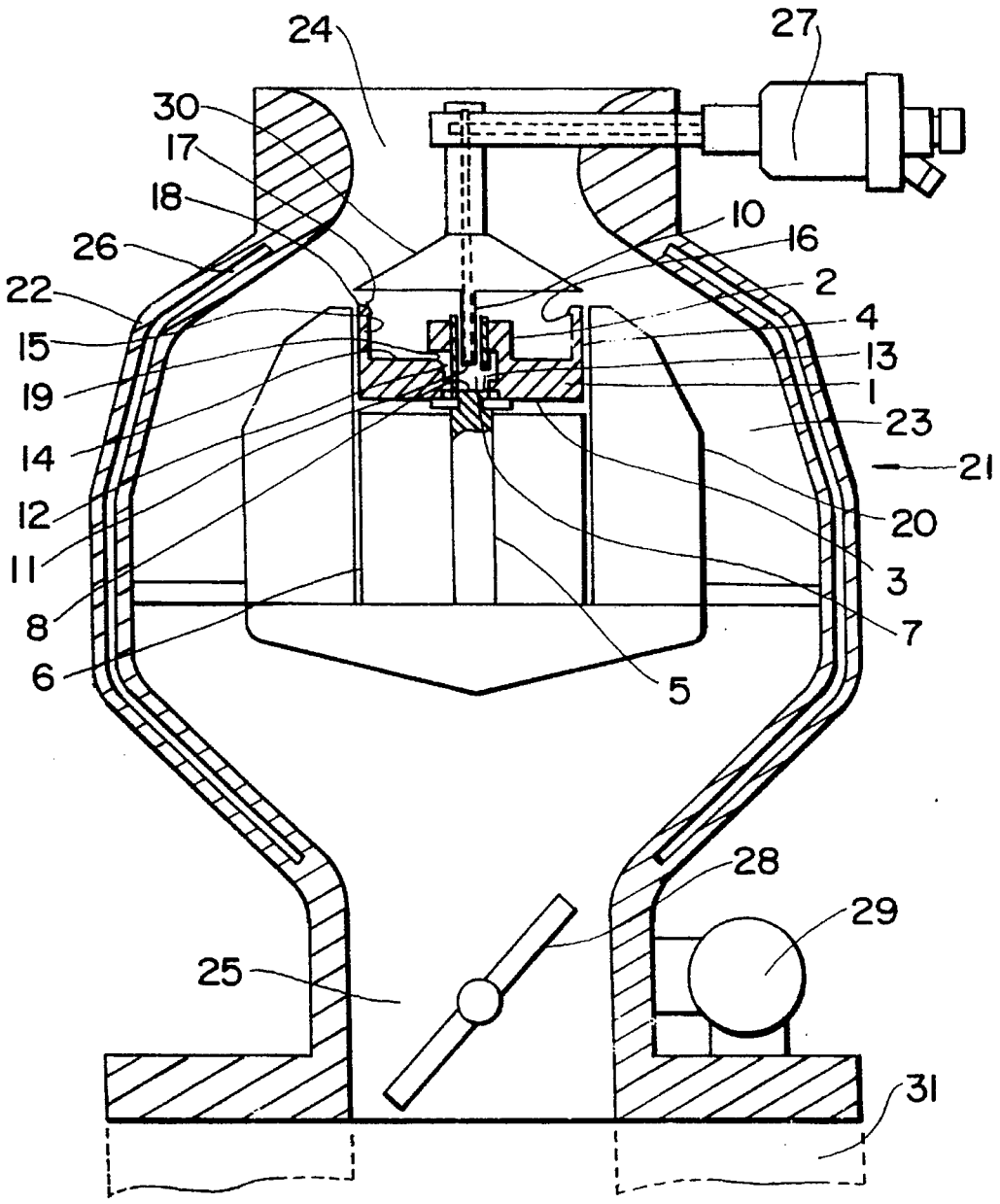
FIG. 1 shows schematically a partial longitudinal section through a mixture generator according to one embodiment.

The mixture generating apparatus represented in FIG. 1 has a relatively simple construction and essentially comprises a mixing chamber 21 with an air inlet 24 and a mixture outlet 25, a feed pipe 10 with a metering valve 27, a rotary distributor cup I with a driving motor 6 and a control flap 28 with a servomotor 29.

FIG. 1 shows the distributor with the rotary distributor cup 1 which is mounted on a driving shaft 5 of a driving motor 6, is carried therewith in an approximately spherical casing 20 and is axially arranged within the mixing chamber 21. The mixing chamber 21 has a curved, axially symmetrical wall 22 which is adapted to the casing 20, forms therewith a streamlined annular channel 23 and is provided with a schematically indicated heating jacket 26.

The fixed feed pipe 10 in operative connection with the metering valve 27 extends through the air inlet 24 into the distributor cup 1. The outlet opening 11 of the feed pipe 10 may be provided with a check valve, not shown, which closes at atmospheric pressure when the fuel flow is interrupted.

A conical hood 30 covers the open upper end of the distributor cup I at a slight distance above the distributing edge 16 of the cup 1.

The air inlet 24 of the mixing chamber 21 is normally connected to an air filter, not shown, while the mixture outlet 25 is connected to the schematically represented intake line 31 of an Otto engine.

As may further be seen from FIG. 1, the wall 22 of the mixing chamber 21 and the casing 20 of the distributor with the driving motor are of convex form and adapted to one another so that the annular channel 23 provides a streamlined and aerodynamically favorable flow path between the rounded air inlet 24 around the hood 30 and casing 20 and the mixture outlet 25.

The rotary distributor consists of a distributor cup I open at the top with a central hollow stub 2, an annular distributing plate 3 and an ascending cylinder 4 and is mounted on the driving shaft 5 of the motor 6.

The hollow stub 2 here surrounds the free lower end of the driving shaft 5, which has a blind hole and thereby defines a central prechamber 7, which is open at the upper end and has a bottom 8 at the lower end of the blind hole.

The feed pipe 10 extends axially without contact into the central prechamber 7, while its fixed central outlet opening 11 is at a sufficient axial distance from the bottom 8 of the prechamber 7, so that the fuel can axially emerge unimpeded in any desired controlled amount.

An inner slot is further provided in the hollow stub 2 in such manner that the latter together with the tubular end of the driving shaft 5 forms an annular intermediate compartment 12, which communicates with the central prechamber via a radial bore 13 near the bottom 8.

The intermediate compartment 12 communicates with the distributing surface 14 via a second bore 19 in the hollow stub 2, the bores 13 and 19 being arranged diametrically opposite one another.

The distributing plate 3 of the rotary cup 1 has an annular upper distributing surface 14 which extends up to the foot of the ascending cylinder 4, while the latter has an upwardly flaring inner ascending surface 15. The upper end of the ascending surface 15 is moreover connected at the top via an inwardly projecting overflow edge 16 and an adjoining rounded end surface 17 with a distributing edge 18 at the top on the outer side of the ascending cylinder 4 so that the fuel ascending by centrifugal force is deflected radially inwards at the overflow edge 16, is then conducted via the rounded end surface 17 radially outwards to the distributing edge 18, and is very finely divided and uniformly mixed with the surrounding air.

When the mixture generating apparatus is in operation, the driving motor rotates at a very high speed of for example 10,000 rpm and the fuel is supplied in an exactly controlled amount via the metering valve 27 and the feed pipe 10 to the central opening 11, flows out unimpeded therefrom into the prechamber 7, is deflected radially outwards on the bottom 8 delivered by centrifugal force via the bore 13, the intermediate compartment 12 and the bore 19 to the distributing surface 14 of the plate 3.

A fuel film is thereby formed which spreads out radially on the distributing surface 14, climbs up the conical ascending surface 15, is deflected inwards via the overflow edge 16 and, via the end surface 17, reaches the upper distributing edge 16, where the fuel is finely divided and radially discharged.

The fuel distributor is thereby designed in such a manner that the fuel freely emerging from central opening 11 is successively distributed by centrifugal force in the prechamber 7, in the intermediate annular chamber 12, on the distributing surface 14 and the ascending surface 15, is supplied to the overflow edge 16 in the form of a film of fuel of very slight thickness and is divided at the distributing edge 18 in the form of extremely small fuel particles (e.g. drops of 20 micron size), is radially discharged and intimately mixed with the air flow in the annular channel 23.

By means of this arrangement of the distributor cup 1, the amount of fuel discharge, from the opening 11 and controlled via the metering valve 27 is continuously evacuated from the central prechamber 7 by centrifugal force, repeatedly distributed, uniformly spread out and delivered to the overflow edge 16 as an extremely thin film which is fully divided on the end surface 17 and the distributing edge 18 and radially discharged.

This special arrangement and mode of operation of the distributor cup I provides for uniform distribution of the fuel, while any discontinuity is equalized which can occur in particular due to transient effects on variation of the operating conditions or the fuel supply and can more or less jeopardize mixture formation.

The fuel part in the mixture is in this case regulated through the metering valve 27 irrespective of the amount of intake air.

Figure 2:
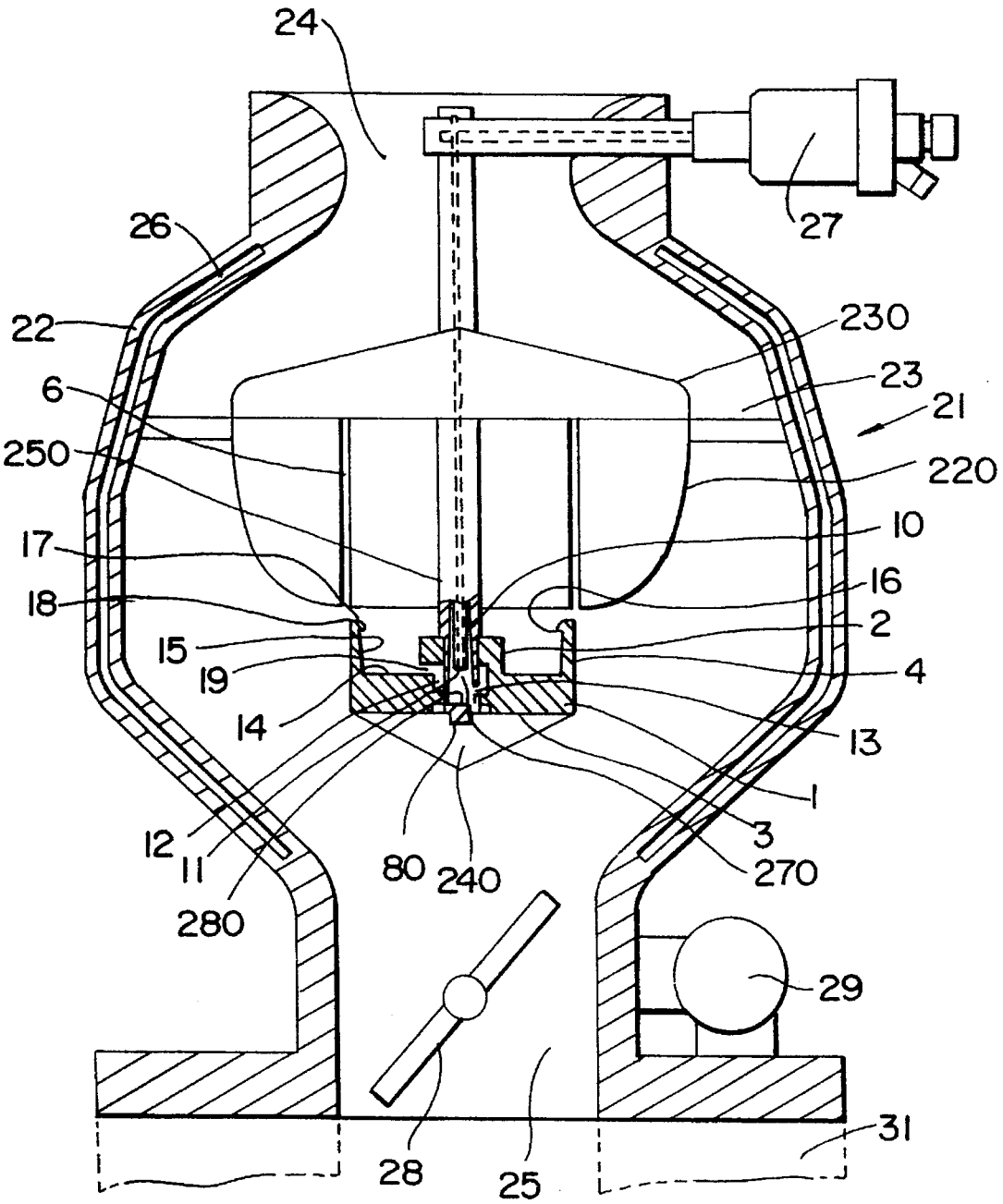
FIG. 2 shows schematically a partial longitudinal section through a mixture generator according to a second embodiment.

The second embodiment similarly represented schematically in FIG. 2 essentially corresponds to the described first embodiment according to FIG. 1, while the fuel distributor 1 is arranged in this case beneath the driving motor 6 and projects from the bottom side of the casing 220, which here has a conical hood 230, The driving motor 6 is moreover inversely arranged within this casing 220, while the free end of the driving shaft 250 is axially directed downwards, extends from the top into the hollow stub 2 and is arranged so that it similarly defines with a bottom part 80 the central prechamber 270 with the bottom 280 and the lateral bore 13.

As appears from FIG. 2, the top side of the casing 220 and the driving motor 6 is covered by a conical hood 230 near the air inlet 24.

The driving shaft 250 has an axial bore, while the fuel-feed pipe 10 extends without contact through the hood 230 and the shaft 250 and the fuel distributor I together with a conical guide body 240 defines a tapered annular channel.

Figure 3:
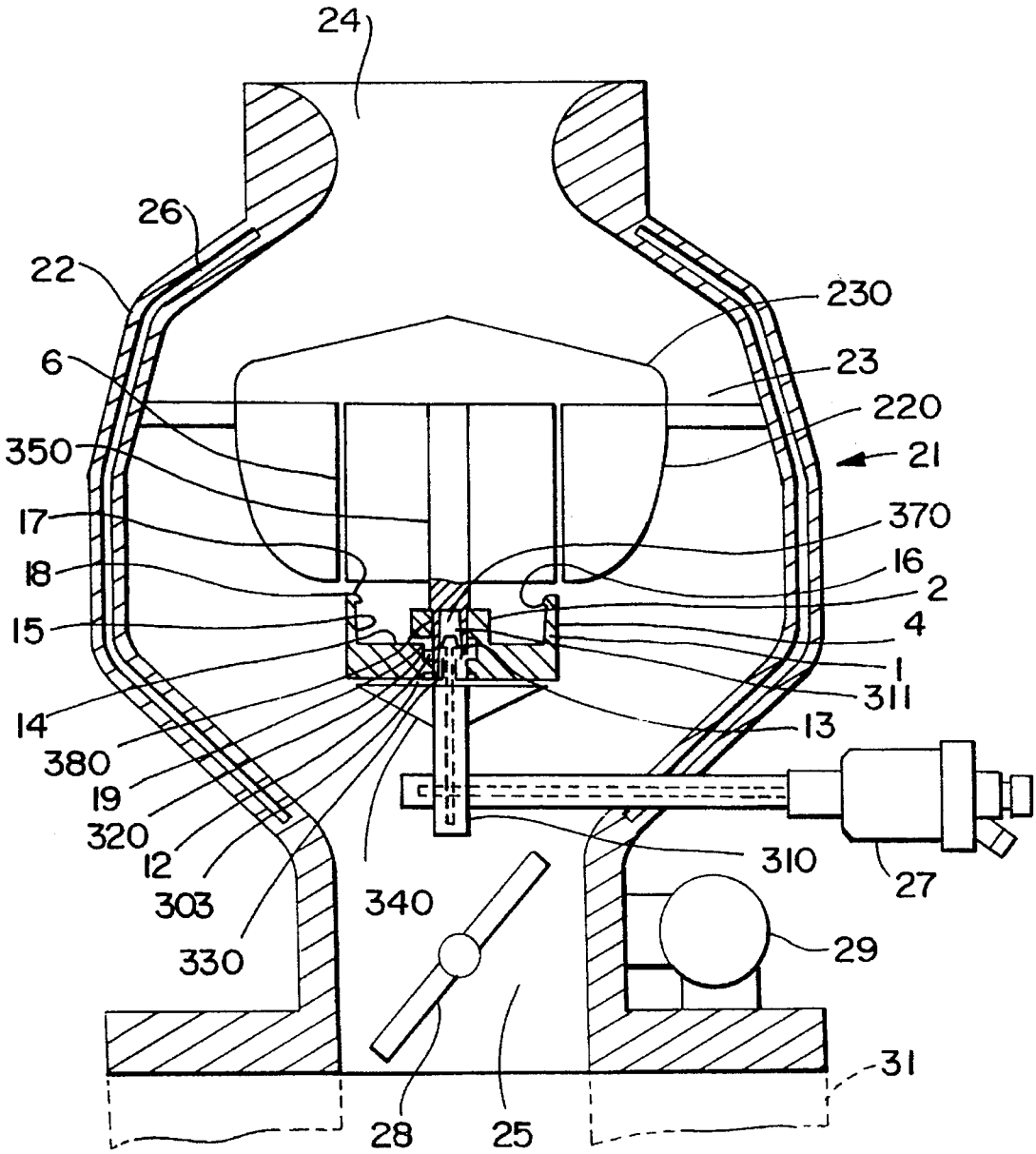
FIG. 3 shows a variant of the embodiment according to FIG. 2.

In the variant shown in FIG. 3, the fuel distributor I likewise overhangs the driving motor 6 at the lower end of the casing 220, while the lower end of the driving shaft 350 has a blind hole and thereby forms a prechamber 370 open at the lower end with a bottom 380 at the upper end and the radial bore 13.

The feed pipe 310 here extends axially from below into this prechamber 370 and its outlet opening 311 is arranged at a given distance beneath the bottom 380. The radial bore 13, the annular intermediate chamber 12 and the radial bore 19 are arranged below this outlet opening 311, while a conical hood 340 is mounted here on the feed pipe 310.

A deflecting head 320 on the upper free end of the feed pipe 310 directs the emerging fuel to the periphery of the prechamber 370 and downwards to the first radial bore 13, while an end sleeve 330 is provided with an axial bore through which the fixed feed pipe 310 extends without contact into the prechamber 370.

Figure 4:
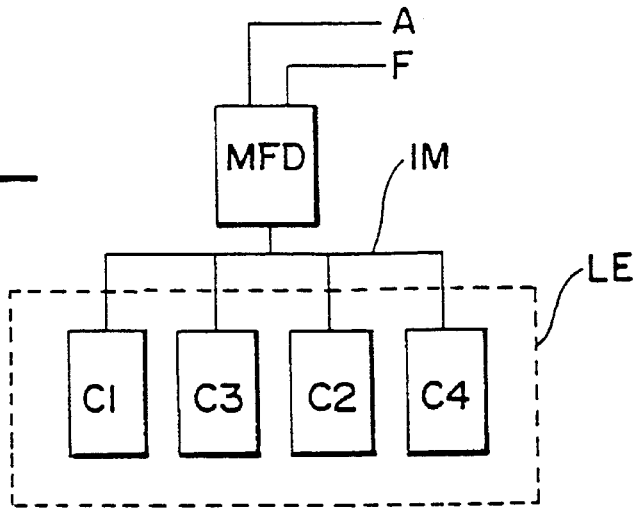
FIG. 4 shows schematically the arrangement of a mixture generating apparatus on an internal combustion engine.

FIG. 4 shows schematically an arrangement of the mixture generating apparatus according to the invention MFD on a lean engine LE, four cylinders C1, C3, C2, C4 being shown here in their ignition sequence.

Figure 5:
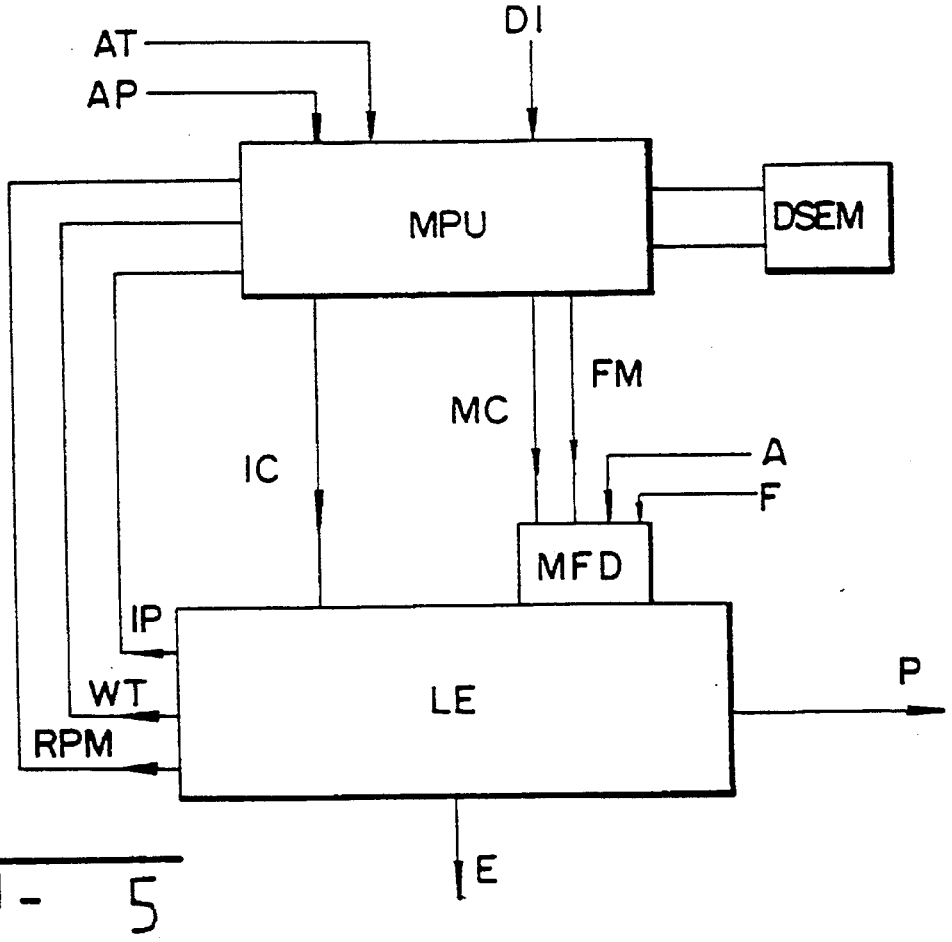
FIG. 5 shows schematically a control system for operation of a lean-burn engine with the mixture generating apparatus.

The fuel-air mixture is continuously produced in the mixture generating apparatus MFD from the intake air A of the engine LE and the fuel F and is distributed via the intake manifold IM of the lean engine LE to the cylinders C1–C4, while the ignition is controlled by an ignition control signal IC (FIG. 5).

The mixture generating apparatus MFD is equipped according to the invention as described with a metering valve and a control flap and constitutes a regulated mixture generator, which enables the amount and the composition of the mixture to be exactly controlled and optimally adapted to all required operating conditions of the lean engine LE without any additional auxiliary equipment.

FIG. 5 shows schematically a control system with a mixture-generating apparatus according to the invention for supplying an Otto engine with lean fuel mixtures with a freely selectable composition, the outlet of the mixing chamber being adapted to the intake manifold of the Otto engine LE.

The control system in FIG. 5 has a data processing unit with a microprocessor unit MPU which in conjunction with a data storage unit DSEM (with EPROM and RAM) which, depending on the power of the Otto engine demanded by the driver and the engine speed, controls the fuel metering valve and the servomotor of the control flap of the mixture generating apparatus MFD as well as the ignition of the Otto engine, according to a stored program corresponding to a performance graph in a predefined operating range of the Otto engine.

The microprocessor unit MPU receives, besides the signal DI corresponding to the power demanded, on one hand input signals via corresponding sensors on the Otto engine, which in each case correspond at least to the engine speed RPM, the intake pressure IP and the cooling-water temperature VVT, and on the other hand further input signals via external sensors, which correspond in each case to the atmospheric pressure AP and the ambient temperature AT.

The microprocessor unit MPU in conjunction with the data storage unit DSEM continuously delivers, as a function of these input signals DI, RPM, IP, VVT, AP, AT, in accordance with said performance graph in the predefined operating range of the Otto engine LE, corresponding control signals FM, MC and IC for regulating the fuel metering valve, the servomotor of the control flap of the mixture generating apparatus and the ignition of the Otto engine.

In the defined operating range of the Otto engine, said characterizing field exactly defines for each operating point the setting of the control flap, of the metering valve and of the engine ignition by means of predetermined values of the corresponding control signals (MC, FM, IC), so that the Otto engine may be optimally operated in the entire said operating range with mixtures with a composition which may be freely selected with maximum excess air while reducing fuel consumption and the emission of pollutants.

Such an automatic control system thereby enables optimal vehicle operation with lean fuel mixtures, high efficiency and reduced fuel consumption while reducing the emission of pollutants.

One thereby achieves, thanks to the controllable mixture generating apparatus according to the invention, a greatly simplified control system, which enables optimal regulation of lean-engine operation by means of only three control signals Both the composition and the amount of the fuel mixture as well as the ignition may moreover be continuously adapted automatically to the optimal operating conditions for the engine concerned.

The preparation of mixtures and supply of Otto engines as provided for in accordance with the invention may moreover be supplemented appropriate measures whereby the engine is still operated efficiently at atmospheric pressure with high Lambda values at small loads.

To this end, a variable valve control could be provided. Selective recycling of a small portion of the exhaust gases via a corresponding return line into the intake manifold may moreover be provided The mixture generating apparatus according to the invention may moreover be supplemented by switching on a compressor before the air inlet of the apparatus at very high loads so as to enable the lean mixture to still ensure operation with a high Lambda value, reduced fuel consumption and reduced emission of pollutants.

The control system may moreover be designed so that the Otto engine can be supplied only briefly with mixtures with a low Lambda value of about 1 at very high loads.

Bench tests were carried out in the framework of the invention on a gasoline engine with a controllable mixture generator according to FIG. 1 combined with a control system according to FIG. 5.

These investigations were carried out on a gasoline engine with the following features: cubic capacity 1.6 l, 4 cylinders, 16 valves, bore 80 ram, stroke 77 mm, compression 11:1, two camshafts, central ignition.

The test bench engine was equipped with the described mixture generating apparatus, the control system and the required measuring equipment and was operated on test bench with the usual load, speed, pressure and temperature determination, so that the loading conditions according to the FTP75 cycle could be simulated on the test bench.

The control system was calibrated in the bench tests so that excess air can be maintained at Lambda values lying between 1.6 and 1.8 in the entire range of the engine performance graph.

The test bench engine was moreover equipped with a relatively simple oxidation catalyst with a conversion rate of 70% for the oxidation of unburned hydrocarbons (HC) and carbon monoxide (CO).

The entire unburned hydrocarbons (HC-values) including methane were taken into account here in the exhaust gas measurements at the exit of the oxidation catalyst.

The measurements with engine operation in the FTPS-Cycle with lean mixtures at Lambda values of 1.6 to 1.8 show that with regard to emission (NOx, HC and CO) the U.S. LEV (Low Emission Vehicle) Standards or even the ULEV (Ultra Low Emission Vehicle) Standards according to the "US 1990 Clean Air Act" are attainable with simultaneous great reduction of consumption, whereby the $CO_2$ emission is reduced accordingly.

The measured gasoline consumption in the entire lean operating range lies considerably lower than with a conventional gasoline engine with a 3-way catalyst. It moreover appeared that the characteristic constant-consumption curves obtained from the measurements had a slighter rise with increasing speed than in conventional engines with a three-way catalyst.

For example at Lambda 1.7 and constant speed of 2000 rpm, the gasoline consumption which was determined varied with the mean pressure (in bar) between 440 gr./kWh at 1 bar and less than 240 gr./kWh at 5 bar.

With regard to the measured emission it may first be mentioned that during stationary engine operation the NOx emission lies in the upper load range with a mean pressure of more than 3 bar at values of 0.2 to 0.3 gr./kWh and in the lower load range with a mean pressure less than 0.3 bar at 0.3 to 0.6 gr./kWh.

It should further be remarked that no emission peaks occur with transient operating conditions.

It is further remarked that the NOx values (determined according to the CLD process) between 20 and 50 ppm may be obtained by appropriate settings in the entire load and speed range.

The measured HC emission is irregularly dispersed in the engine performance graph between 0.25 and 1.2 gr./kWh with single exceptions up to 3 gr./kWh.

The measured CO emission mostly lies below the response threshold (100 ppm CO) of the equipment used.

The HC and CO emission can be further greatly reduced by using an oxidation catalyst with a higher, currently usual conversion rate of more than 90%.

The measured, low HC and CO emission already lie within the strictest United States standards (ULEV Standards) and can be further greatly reduced through further developments.

The oxygen component in the exhaust gases moreover amounts to 5 to 9% (also during idling) and thereby favors the use of an oxidation catalyst with conversion rates of more than 90% already at temperatures around 200° C.

The results of these investigations have clearly shown that thanks to the supply of the gasoline engine with lean mixtures in accordance with the invention with a freely selectable composition and very high excess air (at Lambda values of 1.6 to 1.8) in this relatively unfavorable US-FTP75 Cycle, the nitrogen oxide emission (with addition of a simple oxidation catalyst) as well as the carbon monoxide emission may be reduced below the strictest U.S. exhaust gas standards, while the gasoline consumption and hence the $CO_2$ emission is considerably reduced.

In the framework of these bench tests mixture formation according to the invention and supply during engine operation using different fuels was investigated, normal gasoline, n-pentane, propane and butane among others.

These investigations have shown that these very different fuels permitted, without any structural modification of the mixture generating apparatus, the engine and the control system, efficient, controllable, homogeneous mixture formation and supplying and operating the bench test engine in the lean range at Lambda values of 1.6 to above 2.3.

The invention provides various technical, economic and ecological advantages which are narrowly linked together and are particularly decisive for the optimal operation of Otto engines with lean mixtures and may be briefly summarized as follows:

A. Control of the composition while ensuring efficient mixture formation due to exact metering and axial introduction of the fuel into the rotary distributor cup.

B. Control of the fuel supply irrespective of the air flow rate in one and immediate adjustment to the required quality and quantity of the mixture.

C. Continuous formation of homogeneous mixtures of freely selectable composition and quantity at atmospheric pressure.

D. Uniform combustion of homogeneous, ignitable mixture in the whole combustion chamber.

E. Increased efficiency of the combustion through uniform filling of the combustion chamber with homogeneous mixture, the reaction temperature being uniform and having no local peak values due to Lambda variations.

F. The local reaction temperatures during the combustion of homogeneous mixtures correspond approximately to the adiabatic flame temperature, which with adequate excess air does not substantially exceed the lower nitrogen decomposition limit (above 1800° C.).

G. The homogeneous, exactly controllable external mixture formation allows internal combustion engines to be optimally operated in the entire load range with very high excess air and only negligible nitrogen oxide emission G. Thanks to such an external, homogeneous mixture formation the emission of CO and HC during the homogeneous combustion is moreover substantially decreased and meets the strictest international exhaust gas regulations.

H. The Otto engine responds immediately to load variations without any fuel enrichment owing to the exact, continuous control of the mixture quality through the metering valve in conjunction with the control flap.

I. Fuel consumption is significantly reduced thanks to the mixture formation approximately at atmospheric pressure and the thereby considerably reduced scavenging and heat losses J. Homogeneous, ignitable mixtures with high excess air are produced approximately at atmospheric pressure under all operating conditions of the Otto engine irrespective of the amount of the intake air, solely by means of the rotary distributor with its driving motor.

K. The exact, infinitely variable regulation of the quality and quantity of the mixture is ensured solely with the fuel metering valve in conjunction with the control flap, while the Otto engine can be supplied and optimally operated with lean mixtures practically at atmospheric pressure with very high excess air.

L. The internal combustion engine is efficiently operated in the entire operating range with very high, variable excess air while at the same time reducing fuel consumption and considerably improving the exhaust gas quality, so that a reduction catalyst, or a regulated three-way catalyst becomes superfluous.

For the above reasons, the invention can be used to provide particular advantages for the operation of Otto engines with very high excess air at Lambda values in the range of 1.5 to 1.8 and higher.

The formation of homogeneous mixtures in accordance with the inventions and the uniform combustion thereby achieved likewise provides important practical advantages for other applications, namely for various combustion processes whose course has to be regulated while reducing fuel consumption and the emission of pollutants.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A process for continuously generating fuel-air mixtures of a freely selectable composition in a mixing chamber including an air inlet, a mixture outlet, an axial central feed pipe for liquid fuel, with the feed pipe being operatively associated with a metering valve, and a rotary fuel distributor having a separate driving motor, and a central prechamber, with the prechamber having a bottom and at least one lateral opening for the liquid fuel, an annular channel being provided between the rotary distributor and a wall of said mixing chamber, with the liquid fuel being delivered to the rotary distributor via the prechamber, said process comprising:

(a) dividing the liquid fuel into fine drops by utilizing a rotary distributor in the form of a distributor cup, said distributor cup being open at the top and having an annular distributor plate with an upper annular distributing surface in communication with the central prechamber via the lateral opening and an ascending cylinder, with the cylinder having an ascending inner surface and an upper distributing edge;

(b) arranging the central feed pipe in the central prechamber so that the feed pipe extends axially without contact into said prechamber, with an outlet opening of the feed pipe being arranged at a sufficient axial distance from the bottom of the prechamber so that the liquid fuel can emerge unimpeded in any desired controlled amount from the outlet opening of the feed pipe;

(c) immediately radially carrying away the delivered liquid fuel via the bottom of the prechamber due to centrifugal force and conducting the liquid fuel, via the lateral opening, to the annular distributing surface of the rotary distributor cup; radially spreading out said liquid fuel and forming a continuous film on the distributing surface and on the inner ascending surface of the cylinder; continuously dividing said continuous film on the distributing surface of the ascending cylinder; delivering the divided droplets in the form of extremely fine fuel droplets; and intimately mixing the fine fuel droplets with air flowing in the annular channel; and (d) freely selecting the composition of the fuel-air mixture, in each case, by metering the fuel component of the fuel-air mixture via the metering valve irrespective of the amount of air being present.

2. The process of claim 1, for supplying internal combustion engines with ignitable fuel-air mixtures of a freely selectable composition, further including: supplying the fuel distributor cup with metered amounts of fuel in such a manner that the composition of the mixture produced in each case can be adjusted, irrespective of the amount of air, over the entire operating range of the internal combustion engine.

3. The process of claim 2, for supplying internal combustion engines with ignitable fuel-air mixtures of a freely selectable composition, further including: controlling the fuel metering valve, operatively associated with a control flap, in a previously defined, preferred operating range of the internal combustion engine; supplying metered amounts of fuel to said rotary distributor cup via said metering valve, said metered amounts of fuel in each case being adapted to the required engine power in such a manner that the engine may be optimally operated at each operating point in said preferred operating range; and continuously adapting the amount and the composition of the fuel-air mixture to each desired operating point with the assistance of the control flap in combination with said metering valve.

4. The process of claim 3 further including: adjusting the control flap at each operating point in such a manner as to enable the formation and transport of the fuel-air mixture into an intake manifold of the internal combustion engine approximately at atmospheric pressure at most of the operating points in said preferred operating range.

5. The process of claim 3 for operating internal combustion engines with lean fuel-air mixtures having a Lambda value of at least 1.5, further including: previously defining said preferred operating range and establishing an engine performance graph , the latter determining the optimal setting of the control flap and the fuel metering valve at respective operating points so as to enable the formation and supply of fuel-air mixtures approximately at atmospheric pressure in the preferred operating range of the internal combustion engine, thereby reducing fuel consumption and decreasing the emission of pollutants.

6. A mixture generating apparatus having a mixing chamber with a wall, an air inlet, a mixture outlet, a fixed feed pipe having a free end and an outlet opening operatively associated with a metering valve and a rotary distributor, with the rotary distributor being independently driven, a central prechamber having a bottom and at least one lateral opening, with an annular channel being provided between the rotary distributor and the wall of the mixing chamber, wherein:

(a) the distributor consists of a rotary cup having a distributing plate and an annular distributing surface, with the distributing surface communicating with the prechamber via said at least one lateral opening; and an ascending cylinder having an upper distributing edge; and (b) the free end of the feed pipe extending axially and without contact into the prechamber, with said outlet opening being disposed at an axial distance from the bottom of the prechamber in such a manner so as to enable the liquid fuel to emerge unimpeded and to be immediately carried away, due to centrifugal force, by the bottom of the prechamber and to be supplied via the lateral opening to the distributing surface of the rotary cup and to be radially spread out thereon in the form of a film and to be finely divided at the upper distributing edge.

7. The mixture generating apparatus of claim 6, further including: a driving motor, with the driving motor being disposed beneath the distributor cup, while a distributing edge of the distributing surface is freely arranged and delivers the fuel radially, so that the fuel is mixed with the surrounding air.

8. The mixture generating apparatus of claim 6, further including a driving shaft and wherein said distributor cup comprises a central hollow stub, with the stub limiting the central prechamber, with the driving shaft in combination with the hollow stub constituting an annular intermediate compartment, the latter communicating at least, via a first radial bore, with the central prechamber and, via a second radial bore, with the distributing surface of the distributing plate.

9. The mixture generating apparatus of claim 8, further including: a driving motor, with the driving motor being disposed beneath the distributor cup, while a distributing edge of the distributing surface is freely arranged and delivers the fuel radially, so that the fuel is mixed with the surrounding air.

10. The mixture generating apparatus of claim 6, further including: a driving shaft for rotating said rotary distributor, with a free end of the driving shaft comprising a blind hole, said blind hole, in turn, constituting the central prechamber including said bottom.

11. The mixture generating apparatus of claim 10, further including: a driving motor, with the driving motor being disposed beneath the distributor cup, while a distributing edge of the distributing surface is freely arranged and delivers the fuel radially, so that the fuel is mixed with the surrounding air.

12. The mixture generating apparatus of claim 10, wherein said distributor cup comprises a central hollow stub, with the stub limiting the central prechamber, with the driving shaft in combination with the hollow stub constituting an annular intermediate compartment, the latter communicating at least, via a first radial bore, with the central prechamber and, via a second radial bore, with the distributing surface of the distributing plate.

13. The mixture generating apparatus of claim 12, further including: a driving motor, with the driving motor being disposed beneath the distributor cup, while a distributing edge of the distributing surface is freely arranged and delivers the fuel radially, so that the fuel is mixed with the surrounding air.

14. The mixture generating apparatus of claim 6, further including: a control flap, with the control flap being provided with a servomotor so as to enable the metering valve, with the aid of the control flap, to continuously adjust the composition and the amount of the mixture as well as the mixture to be formed and transported at approximately atmospheric pressure.

15. The mixture generating apparatus of claim 14, further including: a driving motor, with the driving motor being disposed beneath the distributor cup, while a distributing edge of the distributing surface is freely arranged and delivers the fuel radially, so that the fuel is mixed with the surrounding air.

16. The mixture generating apparatus of claim 14, further including a driving shaft and wherein said distributor cup comprises a central hollow stub, with the stub limiting the central prechamber, with the driving shaft in combination with the hollow stub constituting an annular intermediate compartment, the latter communicating at least, via a first radial bore, with the central prechamber and, via a second radial bore, with the distributing surface of the distributing plate.

17. The mixture generating apparatus of claim 16, further including: a driving motor, with the driving motor being disposed beneath the distributor cup, while a distributing edge of the distributing surface is freely arranged and delivers the fuel radially, so that the fuel is mixed with the surrounding air.

18. The mixture generating apparatus of claim 14, further including: a driving shaft for rotating said rotary distributor, with a free end of the driving shaft comprising a blind hole, said blind hole, in turn, constituting the central prechamber including said bottom.

19. The mixture generating apparatus of claim 18, further including: a driving motor, with the driving motor being disposed beneath the distributor cup, while a distributing edge of the distributing surface is freely arranged and delivers the fuel radially, so that the fuel is mixed with the surrounding air.

* * * * *